US007479953B2

(12) United States Patent
Toyoda et al.

(10) Patent No.: US 7,479,953 B2
(45) Date of Patent: Jan. 20, 2009

(54) DISPLAY DEVICE

(75) Inventors: Hironori Toyoda, Mobara (JP); Shinichi Kato, Mobara (JP); Masamitsu Furuie, Mobara (JP); Masaaki Okunaka, Fujisawa (JP); Naoki Tokuda, Mobara (JP)

(73) Assignee: Hitachi Displays, Ltd., Chiba (JP)

( * ) Notice: Subject to any disclaimer, the term of this patent is extended or adjusted under 35 U.S.C. 154(b) by 697 days.

(21) Appl. No.: 11/206,781

(22) Filed: Aug. 19, 2005

(65) Prior Publication Data

US 2006/0050029 A1 Mar. 9, 2006

(30) Foreign Application Priority Data

Sep. 7, 2004 (JP) ..... 2004-259944

(51) Int. Cl.
*G09G 3/22* (2006.01)

(52) U.S. Cl. ..... 345/204; 345/76; 345/103

(58) Field of Classification Search ..... 345/76, 345/77, 82, 103, 204
See application file for complete search history.

(56) References Cited

U.S. PATENT DOCUMENTS 4,338,623 A * 7/1982 Asmus et al. ..... 348/173
4,670,784 A * 6/1987 Goldberg ..... 348/556
5,648,794 A * 7/1997 Jelsma et al. ..... 345/98
5,956,014 A * 9/1999 Kuriyama et al. ..... 345/690
6,069,598 A * 5/2000 Hansen ..... 345/74.1
6,262,772 B1 * 7/2001 Shen et al. ..... 348/445
6,642,544 B1 * 11/2003 Hamada et al. ..... 257/88
2002/0118182 A1 * 8/2002 Luther Weindorf ..... 345/204

* cited by examiner

*Primary Examiner*—Mark A Robinson
*Assistant Examiner*—Jonathan Blancha
(74) *Attorney, Agent, or Firm*—Reed Smith LLP; Stanley P. Fisher, Esq.; Juan Carlos A. Marquez, Esq.

(57) ABSTRACT

The present invention provides a display device which can obviate the possibility of sticking as a whole of a display area even when the brightness is relatively changed on a display area. In a display device, a plurality of pixels are arranged in the inside of a display area and the respective pixels include electrodes to which signals are independently inputted and a common second electrode to which a reference signal with respect to the signals is inputted, the current from the cathode electrode in the first and second display areas are respectively measured, and when the electric current of the first display area is larger than the electric current of the second display area, a potential difference between the cathode electrode of the first display area and the anode electrode of the first display area is made small.

19 Claims, 7 Drawing Sheets

DISPLAY DEVICE

CROSS-REFERENCE TO RELATED APPLICATIONS

The disclosure of Japanese Patent Application No. 2004-259944 filed on Sep. 7, 2004 including the specification, drawings and abstract is incorporated herein by reference in its entirety.

BACKGROUND OF THE INVENTION

1. Field of the Invention

The present invention relates to a display device.

2. Description of the Related Arts

For example, in an organic EL (electroluminescence) display device, by allowing an electric current to independently flow into organic EL elements provided to respective pixels, the organic EL elements are made to respectively emit light and the light emission brightness substantially corresponds to the current quantity.

When the light is emitted from the organic EL elements for a long time, there arises a drawback that the deterioration of the organic EL elements progresses and hence, the light emission brightness is lowered.

When an image is displayed on a display area which is a mass of the respective pixels, such a phenomenon leads a so-called fixed pattern in which the image exhibits the small display brightness and, when this fixed pattern is continued to be displayed for a long time, a so-called sticking is liable to easily occur.

Accordingly, there has been known a technique which obtains an average brightness of a display area by measuring a total quantity of electric current which flows in respective organic EL elements of an organic EL display device and controls voltages applied to the organic EL elements to lower an actual display brightness than a display brightness during a usual display when the average brightness is high.

This technique is based on a phenomenon that when the screen is bright as a whole as in the case of displaying an image which is substantially occupied with a white portion, the display quality is not largely influenced even when the display brightness of the whole screen is lowered, while when the screen is almost dark as in the case of displaying an image which is substantially occupied with a black portion, the display quality is influenced when the display brightness of the bright portion is lowered.

Such a technique is disclosed in Japanese Patent Laid-open 2003-330421.

SUMMARY OF THE INVENTION

However, in the organic EL display device having such a constitution, when the above-mentioned technique is applied to a case in which, for example, a so-called fixed pattern (a pattern with the small fluctuation of the display brightness) such as icon is displayed in other area which is remote from a major portion at the center of a display area, the brightness of the area may be emphasized thus giving rise to a possibility of the generation of sticking in the area.

The present invention has been made under such circumstances and it is an object of the present invention to provide a display device which can obviate the possibility of the occurrence of sticking in a display area as a whole even when the relative difference in brightness is generated in the display area.

To briefly explain the summary of the typical inventions among inventions disclosed in the present invention, they are as follows.

(1) In a display device according to the present invention in which, for example, a plurality of pixels are arranged in the inside of a display area, and the respective pixels include first electrodes to which signals are independently inputted and a common second electrode to which a signal which becomes the reference with respect to the signals is inputted, wherein the display device further includes means which divides the display area into at least a first area and a second area by electrically separating the common second electrode and obtains first information for specifying average brightness of the first area in response to an electric current from the second electrode in the first area, means which supply a referential voltage being emphasized peak corresponding to a value of the information for specifying average brightness and applies the referential voltage being emphasized peak to the second electrode in the first area, means which obtains second information for specifying average brightness of the second area in response to an electric current from the second electrode in the second area, means which compares the information for specifying average brightness and the information for specifying average brightness in the first area, means which, based on the comparison, selects the referential voltage being emphasized peak when the value of the second information for specifying average brightness is smaller than the value of the first information for specifying average brightness, and selects an auxiliary referential voltage which is larger than the referential voltage being emphasized peak when the value of the second information for specifying average brightness is larger than the value of the first information for specifying average brightness, and means which applies the selected voltage to the second electrode in the second area.

The information for specifying average brightness is a group of data which can specify the brightness per unit area. To be more specific, the information for specifying average brightness indicates a current value which flows from the cathode electrode, a current value or a potential difference between the cathode electrode and the anode electrode, or the diode characteristics in case of an organic EL element and hence, the information for specifying average brightness can specify the brightness per unit area.

The referential voltage being emphasized peak implies a voltage which lowers the brightness.

(2) The display device according to the present invention is, for example, on the premise of the constitution (1), characterized in that when the difference between the value of the second information for specifying average brightness and the value of the first information for specifying average brightness is within a range from 14% to 20% of the voltage value which changes from a minimum value to a maximum value of the referential voltage being emphasized peak in comparison of the value of the second information for specifying average brightness and the value of the first information for specifying average brightness, the value of the second information for specifying average brightness is smaller than the value of the first information for specifying average brightness.

(3) The display device according to the present invention is, for example, on the premise of the constitution (1), characterized in that the referential voltage being emphasized peak is obtained by adding a voltage corresponding to the first information for specifying average brightness obtained in the first area to the referential voltage.

(4) The display device according to the present invention is, for example, on the premise of the constitution (1), characterized in that the auxiliary referential voltage is obtained by adding a divided voltage obtained in a power supply part for electroluminescence which supplies a voltage to the first electrodes of the respective pixels to the referential voltage.

(5) The display device according to the present invention is, for example, on the premise of the constitution (1), characterized in that the information for specifying average brightness in the respective areas is obtained in response to an output value of a differential amplifier which has an amplification factor which is inversely proportional to an area of the second electrode in the areas.

(6) The display device according to the present invention is, for example, on the premise of the constitution (1), characterized in that the first area is positioned at the center of the display area.

(7) In a display device according to the present invention in which, for example, a plurality of pixels are arranged in the inside of a display area, and the respective pixels include first electrodes to which signals are independently inputted, a common second electrode to which a signal which becomes the reference with respect to the signals is inputted and a third electrode which controls an electric current which flows between the first electrodes and the second electrode, the display device further includes means which divides the display area into at least a first area and a second area by electrically separating the common second electrode and obtains first information for specifying average brightness of the first area in response to the electric current from the second electrode in the first area, generates a referential voltage being emphasized peak corresponding to a value of the first information for specifying average brightness, and applies the referential voltage being emphasized peak to the second electrode, means which obtains second information for specifying average brightness of the second area in response to an electric current from the second electrode in the second area and compares the second information for specifying average brightness and the first information for specifying average brightness, means which, based on the comparison, selects the referential voltage being emphasized peak when the value of the second information for specifying average brightness is smaller than the value of the first information for specifying average brightness, and selects an auxiliary referential voltage which is larger than the referential voltage being emphasized peak when the value of the second information for specifying average brightness is larger than the value of the first information for specifying average brightness, and means which adds the referential voltage being emphasized peak generated in response to the value of the first information for specifying average brightness to the voltage which is applied to the first electrodes or the third electrode in driving the respective pixels of the first area, and adds either one of the referential voltage being emphasized peak or the auxiliary referential voltage which is selected by the selection to the voltage applied to the first electrodes or the third electrode in driving the respective pixels of the second area.

(8) The display device according to the present invention is, for example, on the premise of the constitution (7), characterized in that in comparison of the second information for specifying average brightness and the first information for specifying average brightness, when the difference between the value of the second information for specifying average brightness and the value of the first information for specifying average brightness is within a range from 14% to 20% of the voltage value which changes from a minimum value to a maximum value of the first information for specifying average brightness in the first area the value of the second information for specifying average brightness is smaller than the value of the first information for specifying average brightness.

(9) The display device according to the present invention is, for example, on the premise of the constitution (7), characterized in that the referential voltage being emphasized peak is obtained by adding a voltage corresponding to the first information for specifying average brightness obtained in the first area to the referential voltage.

(10) The display device according to the present invention is, for example, on the premise of the constitution (7), characterized in that the auxiliary referential voltage is obtained by adding a divided voltage obtained in a power supply part for electroluminescence which supplies a voltage to the first electrodes of the respective pixels to the referential voltage.

(11) The display device according to the present invention is, for example, on the premise of the constitution (7), characterized in that the information for specifying average brightness in the respective areas is obtained in response to an output value of a differential amplifier which has an amplification factor which is inversely proportional to an area of the second electrode in the areas.

(12) The display device according to the present invention is, for example, on the premise of the constitution (7), characterized in that the first area is positioned at the center of the display area.

(13) The display device according to the present invention is, for example, on the premise of the constitution (7), characterized in that the first electrodes in the respective pixels are configured to be connected in common for every line in the display area and to be scanned by a driving circuit thereof, and the addition of the referential voltage being emphasized peak which is generated in response to the value of the first information for specifying average brightness to a voltage applied to the first electrodes and the third electrode in driving the respective pixels in the first area and the addition of the referential voltage being emphasized peak and the auxiliary referential voltage which is selected by the selection to the voltage applied to the first electrodes and the third electrode in driving the respective pixels in the second area which is selected by the selection are performed in conformity with timing of scanning from the driving circuit.

Here, the present invention is not limited to the above-mentioned constitution and various modifications are conceivable without departing from the technical concept of the present invention.

DETAILED DESCRIPTION OF THE INVENTION

Hereinafter, embodiments of a display device according to the present invention are explained in conjunction with drawings.

Figure 2:
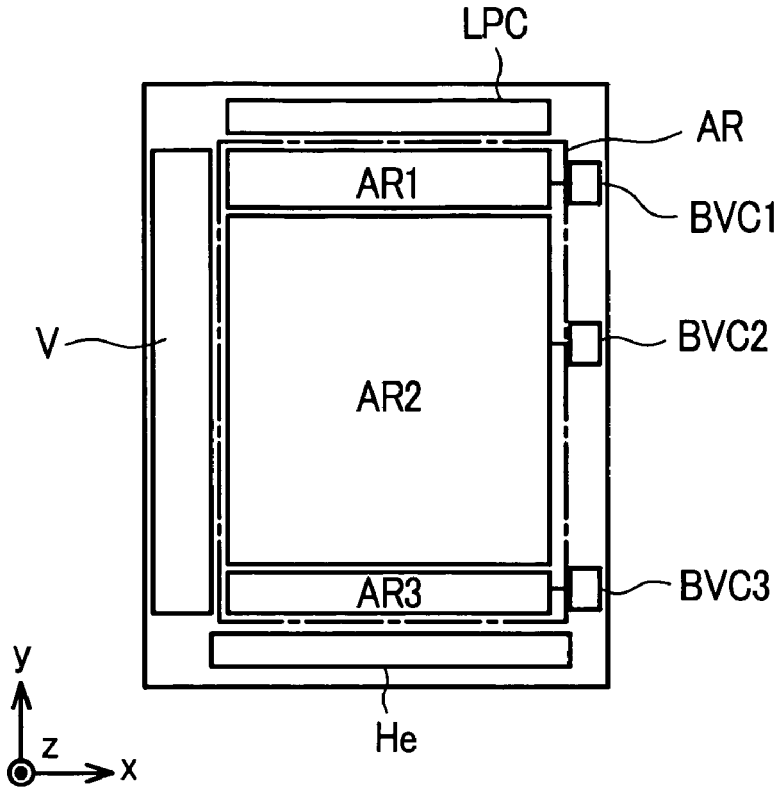
FIG. 2 is an appearance view showing one embodiment of the schematic constitution of the display device according to the present invention.

FIG. 2 is a plan view showing one embodiment of a display device according to the present invention. The display device shown in the drawing includes a display area AR at a center portion thereof except for a slight periphery thereof.

The display area AR includes pixels which are arranged in a matrix array, for example, wherein 240×320 pixels are respectively arranged in the x direction (row direction) as well as in the y direction (column direction).

With respect to these respective pixels, the respective pixels (a group of pixels) which are arranged in parallel in the row direction are sequentially and selectively scanned along the column direction, wherein the pixel information is inputted to the respective pixels of the group of pixels in conformity with the selection timing so as to drive the pixels. That is, a so-called active matrix method is adopted.

Here, the selection of the group of pixels is performed by supplying a scan signal which, out of switching elements provided to the respective pixels, turns on the switching elements of the respective pixels which constitute the group of pixels in common, wherein the scanning signal is generated by a driving circuit for generating scan signal V provided outside the display area AR.

Further, the supply of the pixel information is performed by supplying an image data signal to the pixels through the respective switch elements which are turned on, wherein the image data signal is generated by a driving circuit for generating data signal He arranged outside the display area AR.

Here, the image data signal per se does not have a potential to enable an electroluminescence layer of the pixel to emit light and hence, by a circuit not shown (described in FIG. 6) a power signal (ex. an electric current) CRL which corresponds to the image data signal is led from a power supply circuit for electroluminescence LPC which is arranged outside the display area AR.

Each pixel includes a pair of electrodes which sandwich an electroluminescence layer, wherein by allowing the power signal to flow into the electroluminescence layer through the respective electrodes, the electroluminescence layer emits light. To explain in more detail, assuming the electrode to which the power signal is supplied as the anode AD and the electrode to which a potential which becomes the reference with respect to the power signal as the cathode CD, the electroluminescence layer emits light by a light emitting quantity corresponding to an electric current which flows in the electroluminescence layer arranged in a path from the anode AD to the cathode CD.

Further, the above-mentioned display area AR is constituted of a first display area AR1, a second display area AR2 and a third display area AR3 which are divided in three, for example in the y direction. Here, the division of these respective display areas AR1, AR2, AR3 cannot be individually recognized when viewed with naked eyes and merely implies that these display areas differ from each other in the electrical constitution.

That is, the respective display areas AR1, AR2, AR3 are configured to be controlled to adopt different referential signals (ex. referential voltages) BV with respect to the image data signal supplied to the cathodes CD of the respective pixels of the display areas AR1, AR2, AR3.

To be more specific, in the first display area AR1, the cathodes CD of the pixels are made in common with each other and a potential is supplied to these cathodes CD from a first circuit for supplying referential voltage BVC1 arranged outside the display are a AR. In the second display area AR2, the cathodes CD of the pixels are made in common with each other and a potential is supplied to these cathodes CD from a second circuit for supplying referential voltage BVC2 arranged outside the display area AR. Further, in the third display area AR3, the cathodes CD of the pixels are made in common with each other and a potential is supplied to these cathodes CD from a third circuit for supplying referential voltage BVC3 arranged outside the display area AR.

In other words, the cathode CD of the pixel is electrically separated at boundaries of the respective display areas AR1, AR2, AR3 and the referential signals which are independently generated are supplied to these separated respective cathodes CD.

Here, the above-mentioned respective display areas AR1, AR2, AR3 may be configured to conform to an actual condition of a display device of a mobile phone, for example. For example, the first display area AR1 occupies a range from a line 1 to a line 54, the second display area AR2 occupies a range from a line 55 to a line 302, and the third display area AR3 occupies a range from a line 303 to a line 320, wherein the second area AR2 arranged at the center of the display device is constituted as a main display area.

Figure 3:
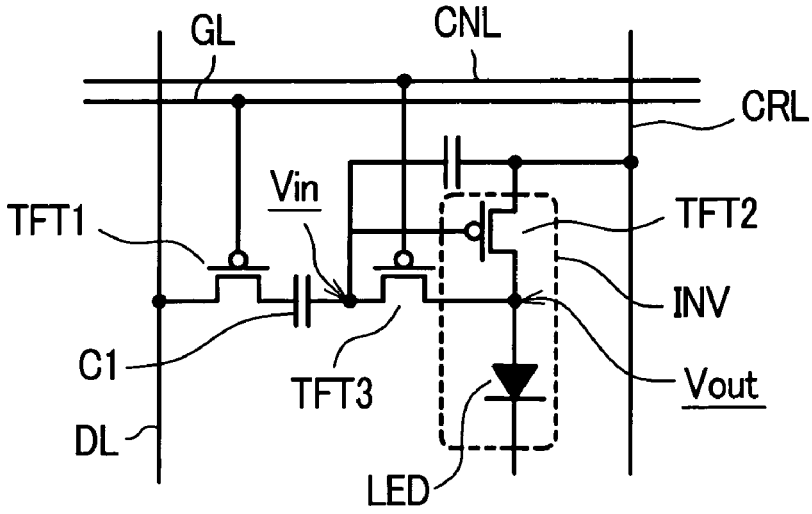
FIG. 3 is a circuit diagram showing one embodiment of the constitution of a pixel of the display device according to the present invention.

FIG. 3 is a view which depicts one embodiment of an equivalent circuit of one pixel out of the respective pixels which are arranged in a matrix array together with the signal lines.

In FIG. 3, a first thin film transistor (control transistor) TFT1 which is turned on in response to the supply of the scanning signal from a gate signal line GL is provided. In conformity with the timing of the first thin film transistor TFT1, the image data signal from the drain signal line DL is configured to reach one electrode out of a pair of electrodes which constitute a capacitive element C1 through the thin film transistor TFT1. The capacitive element C1 is a capacitive element for data storage.

On the other hand, the brightness of an organic EL element LED is controlled by a second thin film transistor (drive transistor) TFT2 which is provided to a current supply line CRL which supplies an electric current to the organic EL element LED.

A gate electrode of the second thin film transistor TFT2 is connected with another electrode of the above-mentioned capacitive element C1. Accordingly, an electric current which corresponds to a voltage held by the capacitive element C1 in response to the image data signal from the drain signal line DL is written in an electroluminescence layer of the organic EL element LED from the current supply line CRL through the second thin film transistor TFT2.

Further, in this embodiment, a reset line CNL and a third thin film transistor TFT3 which is controlled by the reset line CNL are provided, wherein the third thin film transistor TFT3 is interposed between another end of the capacitive element C1 and a node of the second thin film transistor TFT2 and the organic EL element LED.

Here, the second thin film transistor TFT2 and the organic EL element LED in this circuit function as an inverter circuit INV in which the organic EL element LED also works as a load.

Figure 4:
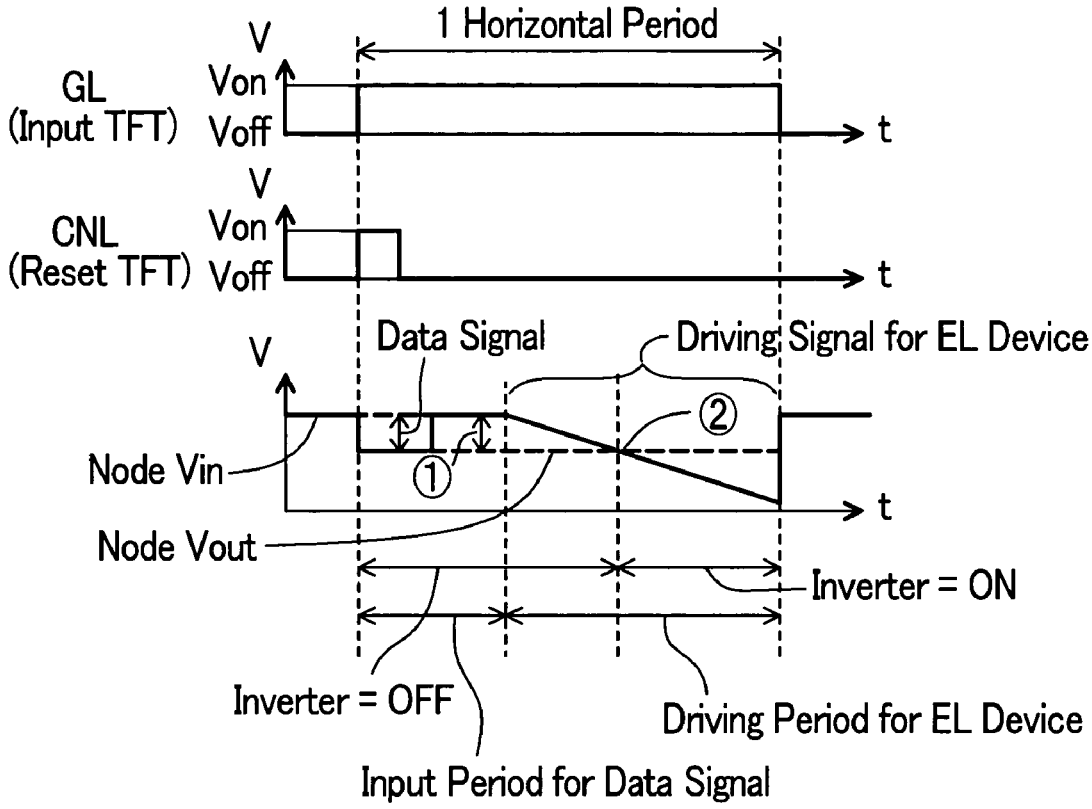
FIG. 4 is a timing chart showing operations in the circuit diagram shown in FIG. 3.

FIG. 4 is a timing chart showing an operation of the equivalent circuit in the above-mentioned pixel.

The scanning signal supplied to the gate signal line GL assumes Von from Voff and this Von state is held for 1 horizontal period. That is, the scanning signal is held at Von until the group of pixels in one line are selected. The first thin film transistor TFT1 holds the ON state during the period.

When the scanning signal rises from Voff to Von, the signal supplied to the reset line CNL rises from Voff to Von, wherein the second thin film transistor TFT2 assumes an ON state during a period that the signal holds the Von.

On the other hand, the image data signal from the drain signal line DL is stored in one electrode of the capacitive element C1 which is connected with the drain signal line DL through the first thin film transistor TFT1, and a potential corresponding to the image data signal is set at a node-in (Vin) and a node-out (Vout) of another electrode side.

When the signal supplied to the reset line CNL becomes Von to Voff, the second thin film transistor TFT2 is turned off. In this stage, the node-out (Vout) holds the potential which corresponds to the image data signal and this potential becomes an operation threshold of the inverter circuit INV and the inverter circuit INV is held in an OFF state.

During a driving period of the respective pixels, a drive signal which is formed of a triangular wave signal is supplied to the drain signal line DL and hence, the potential of the node-in (Vin) is gradually lowered.

Then, when the potential of the node-in (Vin) becomes lower than the above-mentioned potential at the node-out (Vout) corresponding to the image data signal, the voltage applied to the gate of the second thin film transistor TFT2 which constitutes the inverter circuit INV turns on the second thin film transistor TFT2 and an electric current flows into the organic EL element LED from the power supply line CRL.

Thereafter, when the potential of the node-in (Vin) exceeds the potential of the node-out (Vout), the second thin film transistor TFT2 is turned off and the supply of the electric current to the organic EL element LED is stopped.

Figure 8:
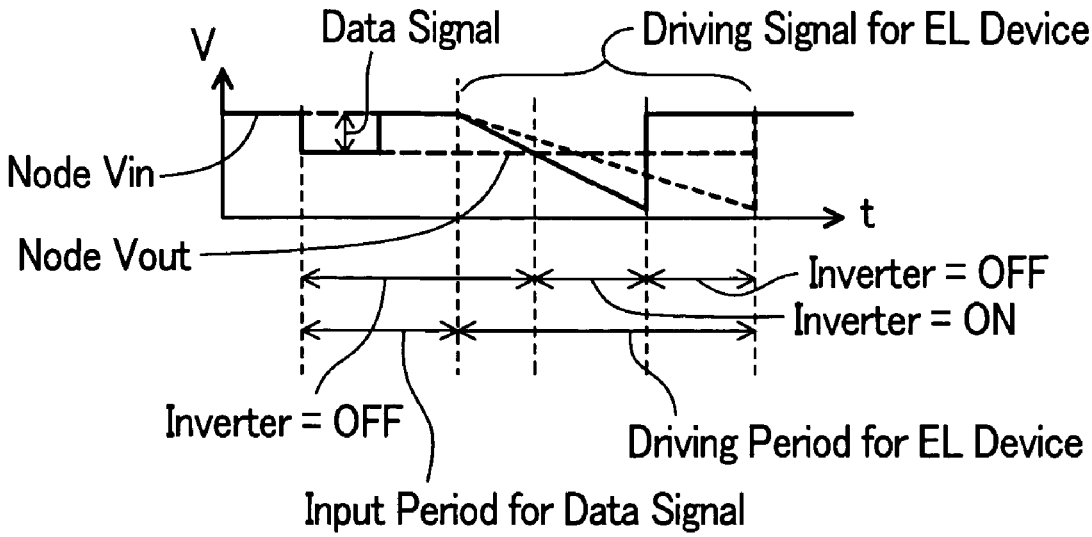
FIG. 8 is a view showing the magnitude of the brightness of the pixel of the display device according to the present invention in a form of the relationship of the brightness with drive signals.

Here, FIG. 8 is a view depicted corresponding to the image data signal (EL drive signal) from the drain signal line DL shown in FIG. 4 and explains that the magnitude of the brightness depends on the ON period of the inverter circuit INV.

Figure 1:
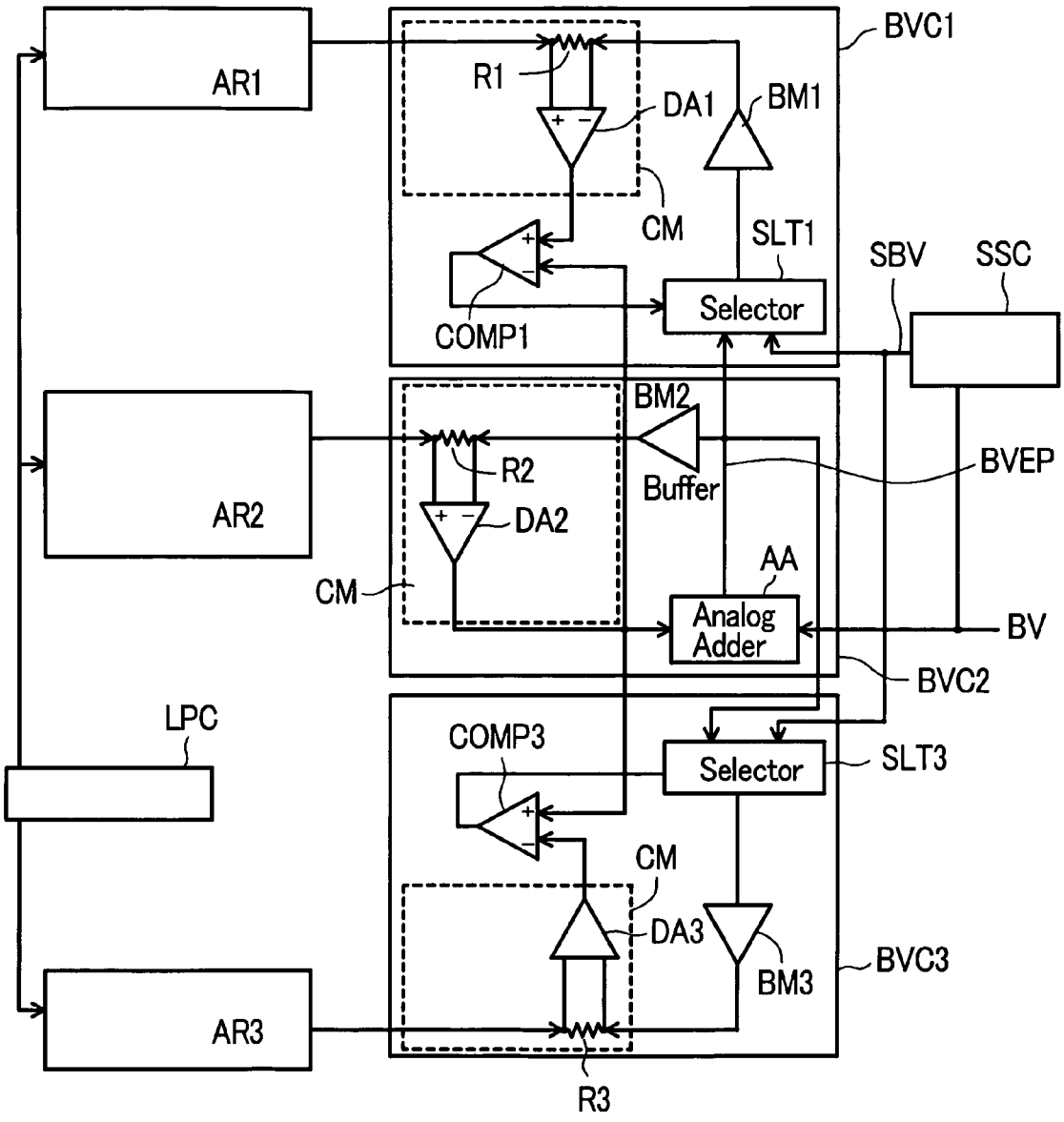
FIG. 1 is a constitutional view showing one embodiment of a display device according to the present invention.

FIG. 1 is a view showing the constitution of circuits for supplying referential signal BVC1, BVC2, BVC3 which respectively supply the referential signals to the first display area AR1, the second display area AR2 and the third display area AR3 in the display area AR shown in FIG. 2.

First of all, the second display area AR2 which constitutes the main display area out of the display area AR is explained. An electric current from a power source (for example, 15V) of the power supply part for electroluminescence LPC reaches the second cathode CD2 from the anode AD of each pixel in the second display area AR2 through the light emitting layer LED. The second cathode CD2 is, as described above, used in common in the respective pixels of the second display area AR2.

The second cathode CD2 is connected to the circuit for supplying referential signal BVC2 and an electric current from the second cathode CD2 flows in a resistor R2 and the potential difference is generated between both ends of the resistor R2 due to the voltage drop.

By applying the respective voltages at both ends of the resister R2 to respective terminals of a differential amplifier DA2, the information for specifying average brightness of the second display area AR2 is obtained as an output of the differential amplifier DA2.

Here, a differential amplifier which has the substantially same function as the differential amplifier DA2 is also provided to the second and the third circuits for supplying referential signal BVC2, BVC3 described later. The differential amplifier DA2 is configured to have the amplification factor which is smaller than the amplification factors of the differential amplifiers DA of the circuits for supplying referential signal BVC2, BVC3. This is because that the display area AR2 has the larger number of pixels than the display areas AR1, AR3 and an electric current which is fetched in the circuit for supplying referential signal BVC2 is large. In other words, the amplification factors of the respective differential amplifier DA2 correspond to the area of the second cathode CD of the display area AR and have the inversely proportional relationship with respect to the area.

The information for specifying average brightness is configured to be outputted to the respective one of the first, the second and the third circuits for supplying referential voltages BVC1, BVC3 described later and is inputted to an analogue adder circuit AA in the inside of the second circuit for supplying referential signal BVC2.

The referential voltage (for example, 0V) is supplied to the analogue adder circuit AA, while the referential voltage being emphasized peak BVEP (for example, 0 to 3V) which is the value obtained by adding the voltage which corresponds to the information for specifying average brightness to the referential voltage is outputted.

The referential voltage being emphasized peak is applied to the second cathode CD of the display area AR2 through a buffer circuit BM2 as well as a resistor R2 of the differential amplifier DA2.

Accordingly, when the average brightness of the image displayed on the second display area AR2 is high, the value of the referential voltage being emphasized peak is increased correspondingly, and the voltage applied to the organic EL elements of the respective pixels in the second display area AR2 can be lowered. To the contrary, when the average brightness is low, the value of the referential voltage being emphasized peak is lowered correspondingly and, at the same time, the voltage applied to the organic EL elements of the respective pixels can be increased.

As described above, the above-mentioned provision is provided in view of the phenomenon that when the screen is bright as a whole as in the case of displaying an image which has a large white portion, even when the display brightness of the whole screen is lowered, the display quality is hardly influenced, while when the whole screen is substantially dark as in the case of displaying an image which includes a large black portion, when the display brightness of the bright portion is dropped, the display quality is influenced.

Next, in the first display area AR1, the electric current from the power source such as the power supply part for electroluminescence LPC reaches the first cathode CD from the anode AD of each pixel of the first display area AR1 through the light emitting layer LED. As described above, the first cathode CD is used in common with respect to the respective pixels in the first display area AR1.

The first cathode CD is connected to the first circuit for supplying referential signal BVC1, the electric current from the second cathode CD flows in the resistance R1, and the potential difference is generated between both ends of the resistor R1 due to the voltage drop.

Since the respective voltages at both ends of the resistor R1 are applied to the respective terminals of the differential amplifier DA1, it is possible to obtain the information for specifying average brightness of the first display area AR1 as an output of the differential amplifier DA1.

The differential amplifier DA1 is configured to have the larger amplification factor than the second circuit for supplying referential signal BVC2. This is because that the first display area AR1 has the smaller number of pixels than the second display area AR2 and hence, the voltage which is fetched in the first circuit for supplying referential signal BVC1 becomes small.

The information for specifying average brightness from the first differential amplifier DA is inputted to one terminal of a comparator COMP1 and is compared with the information for specifying average brightness from the above-mentioned second circuit for supplying referential signal BVC2 which is inputted to another terminal of the comparator COMP1, and the information indicative of a result of the comparison is inputted to a selector SLT1.

Here, the comparator COMP1 outputs the information having a logic value "1", for example, when the information for specifying average brightness is sufficiently large with respect to the information for specifying average brightness from second circuit for supplying referential signal BVC2, while the comparator COMP1 outputs the information having a logic value "0", for example, when these information are substantially equal, and the comparator COMP1 outputs the information having a logic value "0" when the information for specifying average brightness is further sufficiently small with respect to the information for specifying average brightness from the second circuit for supplying referential signal BVC2.

The case that the information for specifying average brightness is substantially equal to the information for specifying average brightness from the second circuit for supplying referential signal BVC2 implies that, for example, the difference between the input voltages to be compared is within 0.5V. That is, when the information for specifying average brightness is larger than the information for specifying average brightness from the second circuit for resupplying referential signal BVC2 by 0.5V or more, the information having the logic value "1" is outputted, while when the difference between these information is within 0.5V, the information having the logic value "0" is outputted.

The above-mentioned 0.5V is set such that the referential voltage being emphasized peak described later is changed from 0V (minimum value) to 3V (maximum value) and approximately 17% of the voltage value 3V within the range becomes 0.5V. This 0.5V corresponds to a range which allows a viewer to recognize that the brightness is substantially equal with naked eyes even when there exists the difference in brightness in a strict sense.

Further, the comparator COMP1 outputs the information having the logic value "0" when the information for specifying average brightness is smaller than the information for specifying average brightness from the circuit for supplying referential signal BVC2 by 0.5 B or more.

To the above-mentioned selector SLT1 to which the information from the comparator COMP1 is inputted, besides the above-mentioned information, the referential voltage being emphasized peak from the first circuit for supplying referential signal BVC1 and the auxiliary referential voltage from an auxiliary referential voltage generating circuit SSC are supplied and either one of the referential voltage being emphasized peak and the auxiliary referential voltage is outputted corresponding to the information.

For example, the auxiliary referential voltage is selected when the logic value of the information is "1", while the referential voltage being emphasized peak is selected when the logic value of the information is "0".

This implies that when the information for specifying average brightness of the first display area AR1 is larger than the information for specifying average brightness of the second display area AR2, the auxiliary referential voltage is selected, while when the information for specifying average brightness of the first display area AR1 is smaller than the information for specifying average brightness of the second display area AR2, the referential voltage being emphasized peak is selected.

Here, the auxiliary referential voltage generating circuit SSC is configured such that the above-mentioned referential voltage (for example, 0V) is supplied to the auxiliary referential voltage generating circuit SSC and the auxiliary referential voltage generating circuit SSC outputs the voltage which is obtained by adding the referential voltage and the output voltage obtained by dividing the voltage of the above-mentioned power supply part for electroluminescence LPC, for example, as the auxiliary referential voltage. The auxiliary referential voltage generating circuit SSC is set as a value equal to the maximum value of the referential voltage being emphasized peak.

Further, the referential voltage being emphasized peak or the auxiliary referential voltage which is outputted from the above-mentioned selector SLT1 is applied to the first cathodes CD of the first display area AR1 as a cathode voltage Vcath through a buffer circuit BM1.

Here, although the third display area AR3 has the same constitution as the first display area AR1, the constitution is repeatedly explained.

The electric current from the power source such as the luminance power source part LPC reaches the third cathode CD from the anode AD of each pixel of the third display area AR3 through the light emitting layer LED. As described above, the third cathode CD is used in common with respect to the respective pixels in the third display area AR3.

The third cathode CD is connected to the third circuit for supplying referential signal BVC3, the electric current from the third cathode CD3 flows in the resistance R3, and the potential difference is generated between both ends of the resistor R3 due to the voltage drop.

Since the respective voltages at both ends of the resistor R3 are applied to the respective terminals of the differential amplifier DA3, it is possible to obtain the information for specifying average brightness of the third display area AR3 as an output of the differential amplifier DA3.

The information for specifying average brightness from the third differential amplifier DA3 is inputted to one terminal of a comparator COMP3 and is compared with the information for specifying average brightness from the above-mentioned second circuit for supplying referential signal BVC2 which is inputted to another terminal of the comparator COMP3, and the information indicative of a result of the comparison is inputted to the selector.

Here, the comparator COMP3 outputs the information having a logic value "1", for example, when the information for specifying average brightness is sufficiently large with respect to the information for specifying average brightness from the circuit for supplying referential signal BVC2, the comparator COMP3 outputs the information having a logic value "0" when these information are substantially equal, and the comparator COMP3 outputs the information having a logic value "0", for example, when the information for specifying average brightness is sufficiently small with respect to the information for specifying average brightness from the circuit for supplying referential signal BVC2. That is, in the same manner as the comparator COMP1 of the circuit for supplying referential signal BVC1, when the information for specifying average brightness is larger than the information for specifying average brightness from the circuit for supplying referential signal BVC2 by 0.5V or more, the information having the logic value "1" is outputted, while when the difference between these information is within 0.5V, the information having the logic value "0" is outputted. Further, when the information for specifying average brightness is smaller than the information for specifying average brightness from the circuit for supplying referential signal BVC2 by 0.5V or more, the information having the logic value "0" is outputted, To the above-mentioned selector SLT3 to which the information from the comparator COMP3 is inputted, besides the above-mentioned information, the referential voltage being emphasized peak from the circuit for supplying referential supplying referential signal BVC1 and the auxiliary referential voltage from an auxiliary referential voltage generating circuit SSC are supplied and either one of the referential voltage being emphasized peak and the auxiliary referential voltage is outputted corresponding to the information.

The auxiliary referential voltage is selected when the logic value of the information is "1", while the referential voltage being emphasized peak is selected when the logic value of the information is "0".

Further, the referential voltage being emphasized peak or the auxiliary referential voltage which is outputted from the above-mentioned selector SLT3 is applied to the first cathodes CD of the third display area AR3 through a buffer circuit BM3.

Figure 5A:
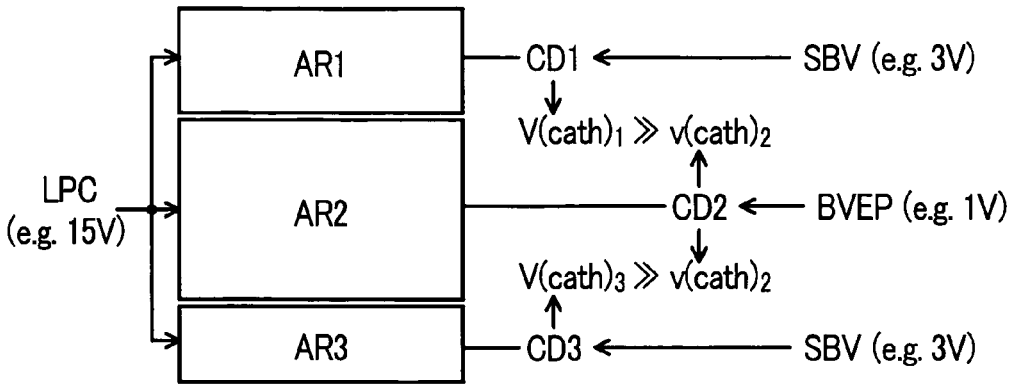
FIG. 5 is an explanatory view showing a display mode of the display device according to the present invention in a form of the relationship between a referential voltage being emphasized peak and an auxiliary referential voltage.
Figure 5B:
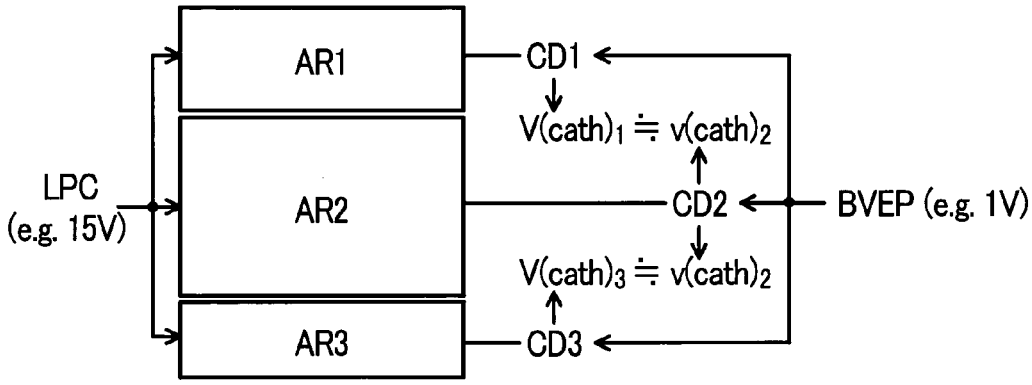
Figure 5C:
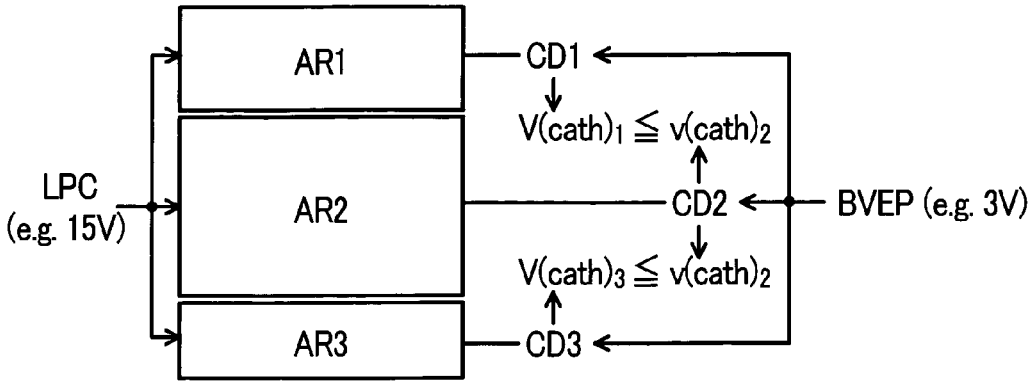
Figure 6:
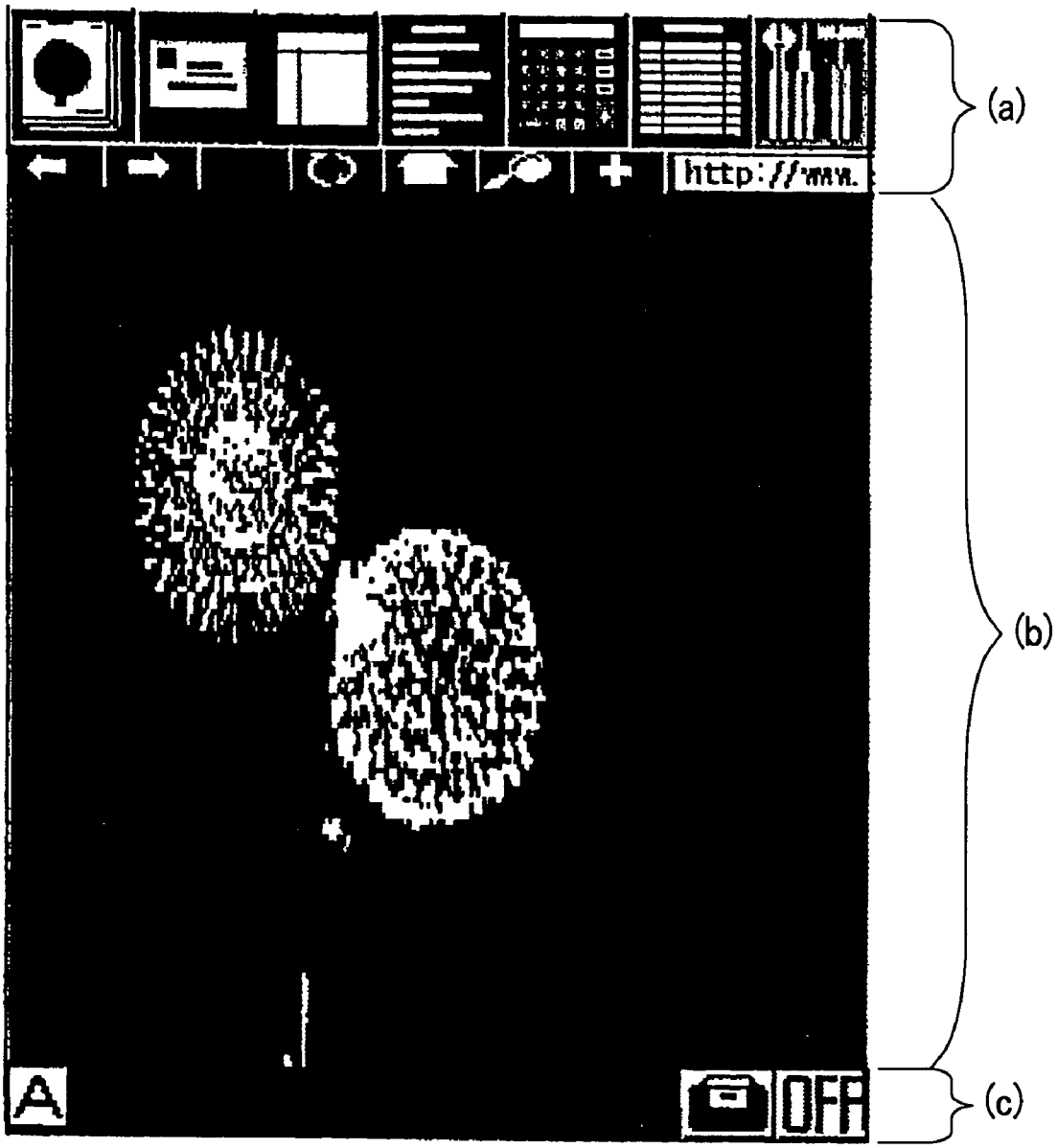
FIG. 6 is an appearance view showing the schematic constitution of one embodiment of the display device according to the present invention together with an image thereof.

FIG. 5A to FIG. 5C are explanatory views for explaining which one of the referential voltage being emphasized peak and the auxiliary referential voltage is selected depending on the display mode of the above-mentioned organic EL display device. Here, the schematic constitution of the display area AR of the above-mentioned organic EL display device is shown in FIG. 6. In the drawing, symbol (a) indicates the first display area AR1, symbol (b) indicates the second display area AR2, and symbol (c) indicates the third display area AR3.

First of all, FIG. 5A shows a case in which, in the display area AR of the organic EL display device, a menu display of OS, for example, is performed on the first display area AR1 and the third display area AR3, while a white display is performed on a black background as in the case of a content of a web browser, for example, on the second display area AR2. That is, the display with the relatively small brightness is performed on the second display area AR2.

In this case, the referential voltage being emphasized peak is obtained from the information for specifying average brightness from the second cathode CD of each pixel of the second display area AR2, wherein the referential voltage being emphasized peak is applied to the second cathode CD as the second cathode voltage ($V(cath)_2$=1V) and, at the same time, the auxiliary referential voltage 3V is selected for the cathode CD of each pixel of the first display area AR1 and the third display area AR3 and the auxiliary referential voltage is applied to the cathode of each pixel of the first display area AR1 and the third display area AR3 as the first cathode voltage and the third cathode voltage ($V(cath)_1$, $V(cath)_3$=3V).

As the referential voltage with respect to the image data signal (voltage), the cathode voltage of each cathode CD has the relationship of $V(cath)_1$, $V(cath)_3 > V(cath)_2$ and hence, the first display area AR1 and the third display area AR3 are displayed with the lower brightness than the brightness which is required for the display of the second display area AR2.

Further, FIG. 5B shows the case in which, in the display area AR of the organic EL display device, for example, a display of fireworks is performed over the whole area of the display area AR, that is, over the first display area AR1 to the third display area AR3.

In this case, the referential voltage being emphasized peak (1V) is obtained from the information for specifying average brightness from the second cathode CD of each pixel in the second display area AR2, and the referential voltage being emphasized peak is applied to the second cathode CD as the second cathode voltage (($V(cath)_2$=1V) Then, in the circuits for supplying referential voltages BVC1 and BVC3, it is detected that information for specifying average brightness and the information for specifying average brightness from the first display area AR1 and the third display area AR3 are substantially equal, and the referential voltage being emphasized peak (1V) is selected and applied as the first and third cathode voltages (($V(cath)_1$ and $V(cath)_3$) of the respective cathodes CD of the first display area AR1 and the third display area AR3.

In this case, in the comparison of the average brightness of the first display area AR1 or the average brightness of the third display area AR3 with respect to the average brightness of the second display area AR2, as described above, when the voltage difference corresponding to the respective average brightness is within 0.5V, it is determined that the brightness of the first display area AR1 to the third display area AR3 are substantially equal and the above-mentioned control is performed.

Accordingly, the first display area AR1 to the third display area AR3 perform the displays with uniform brightness.

Further, FIG. 5C shows the case in which a menu display of OS, for example, is performed on the first display area AR1 and the third display area AR3, while a black display is performed on a white background as in the case of a content of an E-mail, for example, on the second display area AR2. That is, the display with the relatively large brightness is performed on the second display area AR2 compared with the first display area AR1 and the third display area AR3.

In this case, the referential voltage being emphasized peak is applied to the cathode CD of each pixel of the second display area AR2 and, at the same time, the referential voltage being emphasized peak (3V) is selected and applied to the cathode CD of each pixel of the first display area AR1 and the third display area AR3 as the first cathode voltage and the third cathode voltage $V(cath)_1$, $V(cath)_3$.

In this case, although the auxiliary referential voltage (3V) may be applied as the voltage applied to each pixel CD, since the referential voltage being emphasized peak assumes 3V or the voltage close to the 3V, the referential voltage being emphasized peak can be used as it is in the same manner as FIG. 5B.

Embodiment 2

Figure 7:
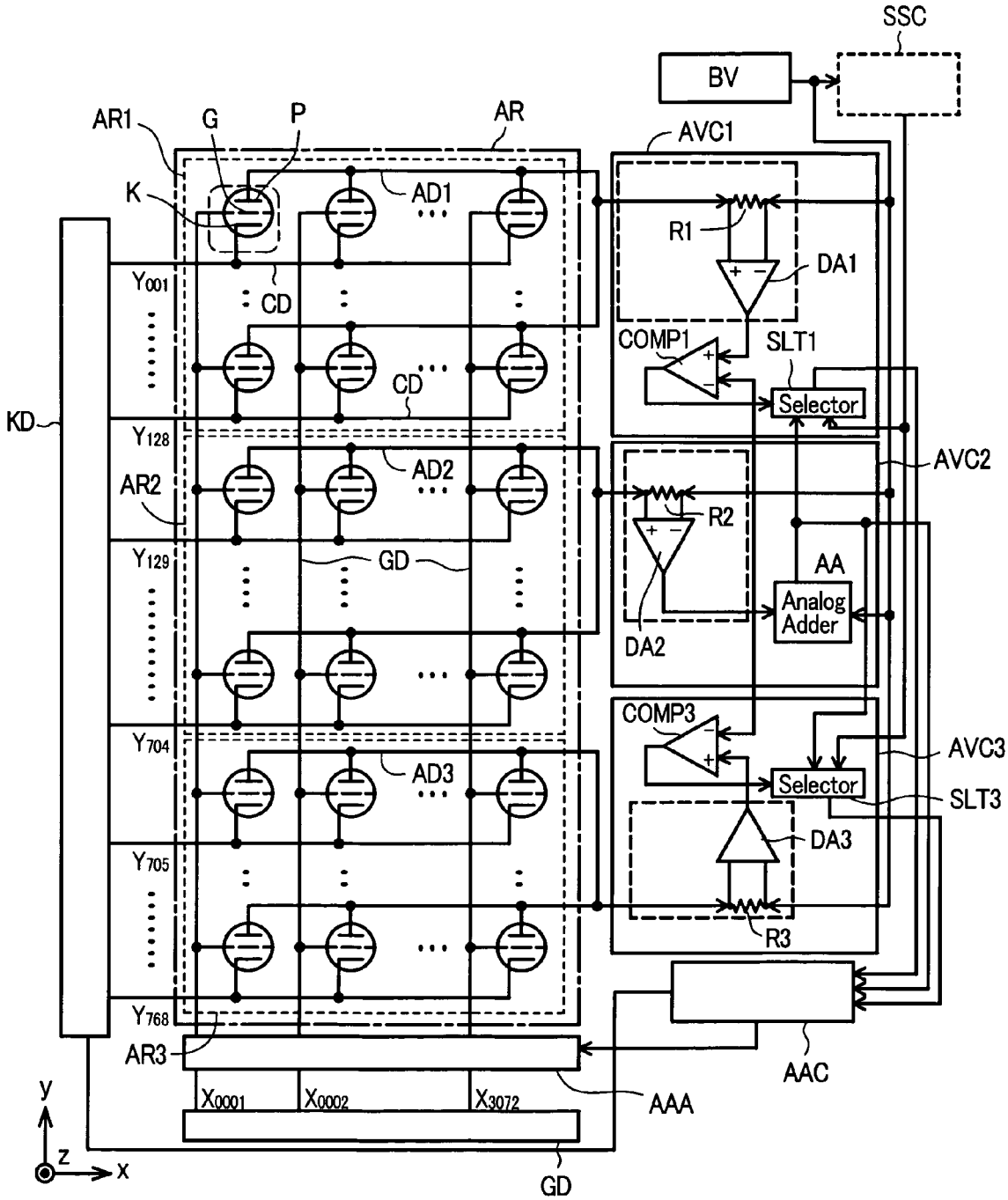
FIG. 7 is a constitutional view showing another embodiment of the display device according to the present invention.

A display device shown in FIG. 7 is a display which is referred to as a so-called FED (Field Emission Display) and, in this FED, this embodiment is provided for realizing the same advantageous effect as the advantageous effect described in the embodiment 1.

Here, the constitution of each pixel in the FED in which pixels are arranged in a matrix array has the constitution explained hereinafter.

On a space-side surface of one substrate out of respective substrates which are arranged to face each other in an opposed manner with an evacuated and inactivated space therebetween, there are provided cathodes CD each of which is formed in common with respect to respective pixels which are arranged in parallel in the x direction and grid electrodes each of which is formed in common to respective pixels arranged in parallel in the y direction.

The cathode CD and the grid electrode are insulated from each other by way of an interlayer insulation film. At the center of the grid electrode of the pixel, a hole which also penetrates an insulation film below the grid electrode is formed and, a portion of the cathode CD is exposed through the hole.

On an upper surface of the exposed cathode electrode CD, a conductive material to which electrons are irradiated is formed. The electrons are emitted from the conductive material due to a potential difference ΔV1 between the conductive material (cathode electrode CD) and the grid electrode.

On the other hand, on a space-side surface of another substrate out of the respective substrates, fluorescent films are formed on portions corresponding to the respective pixels (light shielding films being formed on portions other than the portions). Further, an anode electrode AD (transparent conductive film) is formed in common on the respective pixels in a state that the anode electrode AD also covers the fluorescent films.

A potential difference ΔV2 (>ΔV1) is generated between the conductive material and the anode electrode AD and the electrons emitted from the conductive material are attracted to the anode electrode AD side and the fluorescent body is allowed to emit light. When the potential difference ΔV1 is not generated, even when there exists the large potential difference ΔV2 between the cathode electrode CD and the anode electrode AD, since the cathode electrode CD and the anode electrode AD are spaced apart from each other with an enough distance, electrons are not emitted from the conductive material.

Accordingly, the pixel functions in the similar manner as a vacuum tube and hence, in the following explanation, each pixel is expressed by a symbol equal to a symbol for expressing the vacuum tube, wherein a plate of the vacuum tube corresponds to an anode electrode AD and a grid corresponds to a grid electrode GD and a cathode corresponds to a cathode electrode CD.

In FIG. 7, the respective pixels having the above-mentioned constitution are arranged in a matrix array thus constituting a display area AR and, a cathode driving circuit CDD and a grid driving circuit GDD are arranged outside the display area AR.

The respective signal lines $Y_{001}$ to $Y_{768}$ of the cathode driving circuit CDD are respectively connected to cathodes electrode CD of the respective pixels which are arranged in the x direction in the drawing and the respective signal lines $X_{0001}$ to $X_{3072}$ of the grid driving circuit GDD are respectively connected to grid electrodes GD of the respective pixels arranged in the y direction in the drawing.

Then, although the anodes electrode AD of the respective pixels are usually connected in common, the anodes electrode AD1 in the first display area AR1, the anodes electrode AD2 in the second display area AR2 and the anodes electrode AD3 in the third display area AR3 are formed in a physically separated manner. In other words, the anodes electrode AD of the respective pixels in the first display area AR1 are commonly connected with each other, the anodes electrode AD of the respective pixels in the second display area AR2 are commonly connected with each other and the anodes electrode AD of the respective pixels in the third display area AR3 are commonly connected with each other.

In the same manner as the embodiment 1, this embodiment divides the display area AR into the display areas AR1, AR2, AR3 and detects electric currents which are applied to the respective display areas AR1, AR2, AR3 and flow in the anodes electrode AD. Here, different from the case described in the embodiment 1, the reason why the anodes electrode AD are separated in the above-mentioned division of area lies in that the pixel allows electrons to be irradiated from the cathode electrode CDK and, accordingly, an electric current flows in the direction from the anode electrode AD to the cathode electrode CD.

Here, for example, the first display area AR1 holds a line 1 to a line 128, the second display area AR2 holds a line 129 to a line 704, and the third display area AR3 holds a line 705 line to a line 768.

The anode electrode AD of the first display area AR1 is connected to an anode AD potential circuit AVC1, the anode electrode AD of the second display area AR2 is connected to an anode electrode AD potential circuit AVC2 and the anode AD of the third display area AR3 is connected to an anode electrode AD potential circuit AVC3.

The respective constitutions of the anode AD potential circuit AVC1, the anode AD potential circuit AVC2 and the anode AD potential circuit AVC3 are substantially equal to the constitutions of the circuit for supplying referential signal BVC1, the circuit for supplying referential signal BVC2 and the circuit for supplying referential signal BVC3 which are described in the embodiment 1 with respect to the portions by which the information for specifying average brightness of the respective display areas AR1, AR2, AR3 are obtained and the portions in which the information for specifying average brightness obtained in the second display area AR2 is compared with the information for specifying average brightness of the first display area AR1 and the third display area AR3. Accordingly, the corresponding members which have the same functions as the members of the embodiment 1 are indicated by same symbols.

However, the constitution of this embodiment differs from the constitution of the embodiment 1 in that, first of all, to the first anode electrode AD of the first display area AR1, the second anode electrode AD of the second display area AR2 and the third anode electrode AD of the third display area AR3, the referential voltages are respectively applied through a resistor R1 which is connected to a differential amplifier DA1, a resistor R2 which is connected to a differential amplifier DA2 and a resistance R3 which is connected to a differential amplifier DA3.

Different from the embodiment 1, such provision is provided, for example, for changing the voltages which are applied to the grid electrodes GD of respective pixels in the correction of the brightness.

Further, this embodiment includes an analogue adder grid circuit AAC and three signals which are described hereinafter are inputted to the analogue adder grid circuit AAC.

One of these three signals, in an anode electrode AD reference circuit AVC2, constitutes a signal which is obtained by adding the referential voltage to the information for specifying average brightness obtained using the analogue adder circuit AA. This signal corresponds to the referential voltage being emphasized peak described in the embodiment 1 and is referred to as the referential voltage being emphasized peak hereinafter.

The second signal is constituted of a signal which is selected by the selector SLT1 out of the information for specifying average brightness obtained by the anode referential circuit AVC2 which supply the anode referential circuit and the signal obtained from an auxiliary referential voltage generating circuit SSC. The signal obtained from the auxiliary referential voltage generating circuit SSC corresponds to the auxiliary referential voltage described in the embodiment 1 and is referred to as the auxiliary referential voltage hereinafter.

Here, to the selector SLT1, the output from a comparator COMP1 is inputted and the signals in this embodiment are as same as the signals used in the embodiment 1. That is, in the comparator COMP1, when the information for specifying average brightness is larger than the information for specifying average brightness from the circuit for supplying referential signal BVC2 by 0.5V or more, the information having a logical value of "1" is outputted, when the difference in the information for specifying average brightness is within 0.5V, the information having a logical value of "0" is outputted and, further, when the information for specifying average brightness is smaller than the information for specifying average brightness from the circuit for supplying referential voltage BVC2 by 0.5V or more, the information having a logical value of "0" is outputted.

In the selector SLT1, when the logical value of the information inputted thereto is "1", the auxiliary referential voltage is selected, while when the logical value of the information inputted thereto is "0", the referential voltage being emphasized peak is selected.

As the third signal, either signal which is selected by the selector SLT3 out of the information for specifying average brightness obtained by the anode referential circuit AVC2 and the signal obtained from the auxiliary referential voltage generating circuit SSC is used. The signal obtained from the auxiliary referential voltage generating circuit SSC forms the auxiliary referential voltage.

Here, to the selector SLT3, the output from a comparator COMP3 is inputted and the signals in this embodiment are as same as the signals used in the embodiment 1. That is, in the comparator COMP3, when the information for specifying average brightness is larger than the information for specifying average brightness from the circuit for supplying referential voltage BVC2 by 0.5V or more, the information having a logical value of "1" is outputted, when the difference in the information for specifying average brightness is within 0.5V, the information having a logical value of "0" is outputted and, further, when the information for specifying average brightness is smaller than the information for specifying average brightness from the circuit for supplying referential voltage BVC2 by 0.5V or more, the information having a logical value of "0" is outputted.

In the selector SLT3, when the logical value of the information inputted thereto is "1", the auxiliary referential voltage is selected and, when the logical value of the information inputted thereto is "0", the referential voltage being emphasized peak is selected.

Further, to the analogue adder grid circuit AAC, a cathode voltage output timing signal is inputted from the cathode driving circuit KDD and, in response to the inputting of the signal, signals corresponding to the above-mentioned three signals are respectively outputted.

That is, when the first display area AR1 is scanned using the cathode driving circuit KDD, the signal corresponding to the signal obtained from the selector SLT1 of the anode referential circuit AVC1 is outputted, when the second display area AR2 is scanned using the cathode CD driving circuit KD, the signal corresponding to the signal obtained from the analogue adder circuit AA of the anode AD referential circuit AVC2 is outputted and, when the third display area AR3 is scanned using the cathode CD driving circuit KD, the signal corresponding to the signal obtained from the selector SLT3 of the anode referential circuit AVC3 is outputted.

Then, the output from the analogue adder grid circuit AAC is inputted to an analogue adder circuit AAA. This analogue adder circuit AAA is configured to add the output from the analogue adder circuit AAC to the respective outputs to the display area AR of the grid electrode driving circuit GD.

That is, the signal fed to the first display area AR1 from the grid electrode driving circuit GD is subjected to a voltage grid in response to a signal obtained by the anode AD referential circuit AVC1, the signal fed to the second display area AR2 from the grid electrode driving circuit GD is subjected to a voltage control in response to a signal obtained by the anode AD referential circuit AVC2, and the signal fed to the third display area AR3 from the grid electrode driving circuit GD is subjected to a voltage control in response to a signal obtained by the anode AD referential circuit AVC3.

Accordingly, it is needless to say that the analogue adder grid circuit AAC is not limited to the signal from the grid electrode driving circuit GD and the signal from the anode CD driving circuit KD may be controlled in the same manner as described above.

Accordingly, the display device according to this embodiment can also obtain the same advantageous effects described in the embodiment 1.

In the above-mentioned respective embodiments, the explanation has been made by taking the display device used in a mobile phone as an example. However, the present invention is not limited to such an example and the present invention is directly applicable to other general display device.

The above-mentioned respective embodiments may be used in a single form or in combination. This is because that the advantageous effect of the respective embodiments can be obtained singly or synergistically.

What is claimed is:

1. A display device in which a plurality of pixels are arranged in the inside of a display area, and the respective pixels include first electrodes to which signals are independently inputted and a common second electrode to which a signal which becomes the reference with respect to the signals is inputted, wherein the display device further comprising:

means which divides the display area into at least a first area and a second area by electrically separating the common second electrode and obtains first information for specifying average brightness of the first area in response to an electric current from the second electrode in the first area, means which generates a referential voltage being emphasized peak corresponding to a value of the information for specifying average brightness and applies the referential voltage being emphasized peak to the second electrode in the first area, means which obtains second information for specifying average brightness of the second area in response to an electric current from the second electrode in the second area, means which compares the information for specifying average brightness and the information for specifying average brightness in the first area, means which, based on the comparison, selects the referential voltage being emphasized peak when the value of the second information for specifying average brightness is smaller than the value of the first information for specifying average brightness, and selects an auxiliary referential voltage which is larger than the referential voltage being emphasized peak when the value of the second information for specifying average brightness is larger than the value of the first information for specifying average brightness, and means which applies the selected voltage to the second electrode in the second area.

2. A display device according to claim 1, wherein when the difference between the value of the second information for specifying average brightness and the value of the first information for specifying average brightness is within a range from 14% to 20% of the voltage value which changes from a minimum value to a maximum value of the referential voltage being emphasized peak in comparison of the value of the second information for specifying average brightness and the value of the first information for specifying average brightness, the value of the second information for specifying average brightness is smaller than the value of the first information for specifying average brightness.

3. A display device according to claim 1, wherein the referential voltage being emphasized peak is obtained by adding a voltage corresponding to the first information for specifying average brightness obtained in the first area to the referential voltage.

4. A display device according to claim 1, wherein the auxiliary referential voltage is obtained by adding a divided voltage obtained in an power supply part for electroluminescence which supplies a voltage to the first electrodes of the respective pixels to the referential voltage.

5. A display device according to claim 1, wherein the information for specifying average brightness in the respective areas is obtained in response to an output value of a differential amplifier which has an amplification factor which is inversely proportional to an area of the second electrode in the areas.

6. A display device according to claim 1, wherein the first area is positioned at the center of the display area.

7. A display device in which a plurality of pixels are arranged in the inside of a display area, and the respective pixels include first electrodes to which signals are independently inputted, a common second electrode to which a signal which becomes the reference with respect to the signals is inputted and a third electrode which controls an electric current which flows between the first electrodes and the second electrode, wherein the display device further comprising:

means which divides the display area into at least a first area and a second area by electrically separating the common second electrode and obtains first information for specifying average brightness of the first area in response to the electric current from the second electrode in the first area, generates a referential voltage being emphasized peak corresponding to a value of the first information for specifying average brightness, and applies the referential voltage to the second electrode, means which obtains second information for specifying average brightness of the second area in response to an electric current from the second electrode in the second area and compares the second information for specifying average brightness and the first information for specifying average brightness, means which, based on the comparison, selects the referential voltage being emphasized peak when the value of the second information for specifying average brightness is smaller than the value of the first information for specifying average brightness, and selects an auxiliary referential voltage which is larger than the referential voltage being emphasized peak when the value of the second information for specifying average brightness is larger than the value of the first information for specifying average brightness, and means which adds the referential voltage being emphasized peak generated in response to the value of the first information for specifying average brightness to the voltage which is applied to the first electrodes or the third electrode in driving the respective pixels of the first area, and adds either one of the referential voltage being emphasized peak and the auxiliary referential voltage which is selected by the selection to the voltage applied to the first electrodes or the third electrode in driving the respective pixels of the second area.

8. A display device according to claim 7, wherein, in comparison of the value of the second information for specifying average brightness and the value of the first information for specifying average brightness when the difference between the value of the second information for specifying average brightness and the value of the first information for specifying average brightness is within a range from 14% to 20% of the voltage value which changes from a minimum value to a maximum value of the first information for specifying average brightness in the first area, the value of the second information for specifying average brightness is smaller than the value of the first information for specifying average brightness.

9. A display device according to claim 7, wherein the referential voltage being emphasized peak is obtained by adding a voltage corresponding to the first information for specifying average brightness obtained in the first area to the referential voltage.

10. A display device according to claim 7, wherein the auxiliary referential voltage is obtained by adding a divided voltage obtained in a power supply part for electroluminescence which supplies a voltage to the first electrodes of the respective pixels to the referential voltage.

11. A display device according to claim 7, wherein the information for specifying average brightness in the respective areas is obtained in response to an output value of a differential amplifier which has an amplification factor which is inversely proportional to an area of the second electrode in the areas.

12. A display device according to claim 7, wherein the first area is positioned at the center of the display area.

13. A display device according to claim 7, wherein the first electrodes in the respective pixels are configured to be connected in common for every line in the display area and to be scanned by a driving circuit thereof, and the addition of the referential voltage being emphasized peak generated in response to the value of the first information for specifying average brightness to the voltage which is applied to the first electrodes or the third electrode in driving the respective pixels of the first area, and the addition of either one of the referential voltage being emphasized peak and the auxiliary referential voltage which is selected by the selection to the voltage applied to the first electrodes or the third electrode in driving the respective pixels of the second area are performed in conformity with timing of scanning from the driving circuit.

14. A display device comprising a display area which is constituted of a plurality of light emitting elements, wherein one cathode electrode faces a plurality of anode electrodes in an opposed manner, the display device further comprising:

a first display area and a second display area which are constituted of different cathodes; and means for obtaining information for specifying average brightness of the respective display areas in response to a signal which flows in the cathode electrode; wherein when the brightness of the first display area has the larger brightness than the second display area, a signal applied to the cathode electrodes of the first display area is controlled so as to lower the brightness of the first display area.

15. A display device according to claim 14, wherein the first display area and the second display area are constituted of light emitting elements which are formed on a same substrate, and the respective light emitting elements are driven by active elements which are arranged in a matrix array.

16. A display device according to claim 15, wherein the light emitting layer includes an organic light emitting material between the anode electrode and the cathode electrode.

17. A display device comprising a display area which is constituted of a plurality of light emitting elements, wherein one cathode electrode faces a plurality of anode electrodes in an opposed manner, the display device further comprising a first display area and a second display area which are constituted of different cathodes; wherein an electric current which flows in the cathode electrode of the first display area and an electric current which flows in the cathode electrode of the second display area are respectively measured, and when the electric current which flows in the cathode electrode of the first display area is larger than the electric current which flows in the cathode electrode of the second display area, a potential difference between the cathode electrode of the first display area and the anode electrode of the first display area is made small.

18. A display device according to claim 15, wherein the first display area and the second display area are constituted of light emitting elements which are formed on a same substrate, and the respective light emitting elements are driven by active elements which are arranged in a matrix array.

19. A display device according to claim 18, wherein the light emitting layer includes an organic light emitting material between the anode electrode electrode and the cathode electrode.

* * * * *